US008455775B2

(12) United States Patent
Kim

(10) Patent No.: US 8,455,775 B2
(45) Date of Patent: Jun. 4, 2013

(54) POWER TRANSMISSION APPARATUS FOR HIGH VOLTAGE LOAD BREAKER SWITCH

(75) Inventor: Jeong Han Kim, Chungcheongnam-Do (KR)

(73) Assignee: LSIS Co., Ltd., Anyang-Si, Gyeonggi-Do (KR)

( * ) Notice: Subject to any disclaimer, the term of this patent is extended or adjusted under 35 U.S.C. 154(b) by 175 days.

(21) Appl. No.: 13/118,300

(22) Filed: May 27, 2011

(65) Prior Publication Data

US 2011/0297515 A1 Dec. 8, 2011

(30) Foreign Application Priority Data

Jun. 7, 2010 (KR) ..... 10-2010-0053556

(51) Int. Cl.
*H01H 27/10* (2006.01)

(52) U.S. Cl.
USPC ..... 200/42.01

(58) Field of Classification Search
USPC ..... 200/42.01, 332, 400–401, 318–327; 335/167–174, 21–23; 361/30
See application file for complete search history.

(56) References Cited

U.S. PATENT DOCUMENTS

| | | | | |
|---|---|---|---|---|
| 6,160,234 | A * | 12/2000 | Wehrli et al. | 200/400 |
| 7,397,008 | B2 * | 7/2008 | Ahn et al. | 200/400 |
| 2005/0139462 | A1 * | 6/2005 | Shin | 200/400 |

* cited by examiner

*Primary Examiner* — Edwin A. Leon
(74) *Attorney, Agent, or Firm* — Lee, Hong, Degerman, Kang & Waimey

(57) ABSTRACT

A power transmission apparatus according to an embodiment of the present invention can improve the reliability of an opening operation of the high voltage LBS by using both a main circuit opening driving force of an opening spring and an opening driving force from an actuator mechanism. The power transmission apparatus comprises a main circuit opening power transmission mechanism for transmitting an opening position rotating power of a power transmission shaft to the main circuit switch in order to move the main circuit switch to an opening position.

6 Claims, 4 Drawing Sheets

POWER TRANSMISSION APPARATUS FOR HIGH VOLTAGE LOAD BREAKER SWITCH

CROSS-REFERENCE TO RELATED APPLICATION

Pursuant to 35 U.S.C. §119(a), this application claims the benefit of earlier filing date and right of priority to Korean Application No. 10-2010-0053556, filed on Jun. 7, 2010, the contents of which is incorporated by reference herein in its entirety.

FIELD OF THE INVENTION

The present invention relates to a power transmission apparatus of a high voltage load breaker switch (abbreviated as LBS hereinafter) and, more particularly, to a power transmission apparatus for a high voltage LBS capable of utilizing a driving force of an actuator mechanism as well as an opening spring for a power source in opening a main circuit switch.

DESCRIPTION OF THE RELATED ART

In general, an electric power (in other words electricity) generated to have a voltage of about 20,000V (Volts) in a power plant is transformed to a high voltage suitable for an electric power transmission and then transmitted to a primary substation. The electric power supplied from the primary substation is supplied to a power facility of each consumer through an electric power distribution system including an overhead electric line, an underground distribution line, and the like, and is supplied to an extra-high voltage consumer, a high voltage consumer, and a low voltage consumer through various outdoor transformers.

In this case, a multi-circuit switch is used for the purpose of discriminating power lines of the underground distribution line and divergence. The multi-circuit switch comprises an arc-extinguishing unit largely using sulphur hexafluoride ($SF_6$) gas as an insulating material. The sulphur hexafluoride ($SF_6$) gas, however, has the greenhouse effect 23,900 times that of carbon dioxide ($CO_2$), so the use of sulphur hexafluoride ($SF_6$) gas is restricted throughout the world. Thus, instead, a solid insulated high voltage load breaker switch employing solid insulator such as epoxy as an electrical insulating material between phases of the arc-extinguishing unit, a switching unit, which extinguishes arc generated in opening and closing is increasingly used.

Meanwhile, such a high voltage LBS comprises an actuator providing a driving force to drive the arc-extinguishing unit into three positions: an opening position, a closing position, and a ground position, and a power transmission apparatus delivering mechanical power from the corresponding actuator mechanism as a power for opening, closing, and grounding operations to the main switching unit and the arc-extinguishing unit.

The present invention is directed to the power transmission apparatus of the high voltage LBS. An example of the related art power transmission apparatus of the high voltage LBS may refer to the Korean Registered Patent No. 0832331 which was invented by the inventor of the present invention and filed and registered by the applicant of the present invention.

The power transmission apparatus of the high voltage LBS disclosed in Korean Registered Patent No. 0832331 has significance in that it proposes a means for transforming rotatable power of an actuator mechanism into linear power required for switching a vacuum interrupter and delivering the same in the solid insulated high voltage LBS.

However, in the power transmission apparatus of the related art high voltage LBS, the mechanical power of the actuator mechanism is utilized only for the closing operation of the main circuit switch and switching (opening and closing) operations of a ground switch, and in case of a circuit opening operation of the main circuit switch, a driving force of only an opening spring (in other words a trip spring) is used while driving force of the actuator mechanism is not used but becomes extinct. Thus, a driving source of the opening operation is limited, failing to secure the more reliable opening operation.

SUMMARY OF THE INVENTION

An object of the present invention is to provide a power transmission apparatus of a high voltage LBS capable of utilizing a driving force of an actuator mechanism as well as an elastic force of an opening spring when a main circuit switch is open, thus improving reliability of the main circuit switch The above mentioned object of the present invention can be accomplished by providing a power transmission apparatus for the high voltage load breaker switch according to the present invention. In a high voltage load breaker switch having a main circuit switch for switching a main circuit between an electric power source and an electric load, a ground circuit switch for switching a ground circuit, and an actuator mechanism for actuating the main circuit switch and the ground circuit switch to a closing position or an opening position, a power transmission apparatus for the high voltage load breaker switch according to the present invention disposed between the main circuit switch and the actuating mechanism and between the ground circuit switch and the actuating mechanism to transfer a driving force from the actuating mechanism to the main circuit switch and the ground circuit switch.

The power transmission apparatus according to the present invention comprising:

a power transmission shaft having one end connected to the actuating mechanism;

a cam shaft connected to interwork with the power transmission shaft and having a main cam;

a first operating shaft for driving the main circuit switch to switch a closing position or an opening position;

a second operating shaft for driving the ground circuit switch to switch a closing position or an opening position;

a main circuit link unit having a pair of links connected to the first operating shaft and the main circuit switch respectively and being contactable with one side of the main cam;

a ground circuit link unit having a pair of links connected to the second operating shaft and the ground circuit switch respectively and being contactable with the other side of the main cam;

an opening spring connected between the first operating shaft and the second operating shaft and providing the first operating shaft with an elastic force to rotate when the main circuit switch performs an opening operation, the power transmission apparatus improvement comprising:

a main circuit opening power transmission mechanisms for transferring opening position rotating power of the power transmission shaft to the main circuit switch to enable the main circuit switch to move to an opening position.

The main circuit opening power transmission mechanisms desirably comprise: an opening cam coaxially installed with the main cam on the cam shaft but installed at a different installation angle from installation angle of the main cam, and being rotatable according to a rotation of the cam shaft; and an opening link unit coaxially installed with the main circuit link unit on the first operating shaft but installed at a different installation angle from installation angle of the main circuit link unit, and being contactable with the rotating opening cam to transfer a driving force from the opening cam to the first operating shaft.

The main circuit opening power transmission mechanisms desirably comprise:

a roller installed to be rotatable at an upper end portion of the opening link unit such that it can be rollingly brought into contact with the opening cam The power transmission apparatus desirably further comprise: a ground circuit auxiliary driving cam coaxially installed with the main cam on the cam shaft but installed at a different installation angle from installation angle of the main cam, and being rotatable according to a rotation of the cam shaft; and an auxiliary ground circuit link unit coaxially installed with the ground circuit link unit on the second operating shaft but installed at a different installation angle from installation angle of the ground circuit link unit, and being contactable with the rotating ground circuit auxiliary driving cam to transfer a driving force from the ground circuit auxiliary driving cam to the second operating shaft.

The ground circuit power transmission mechanism desirably further comprises:

a roller rotatably installed at an upper end portion of the auxiliary ground circuit link unit such that it can be rollingly brought into contact with the ground circuit auxiliary driving cam.

The foregoing and other objects, features, aspects and advantages of the present invention will become more apparent from the following detailed description of the present invention when taken in conjunction with the accompanying drawings.

DETAILED DESCRIPTION OF THE INVENTION

Figure 1:
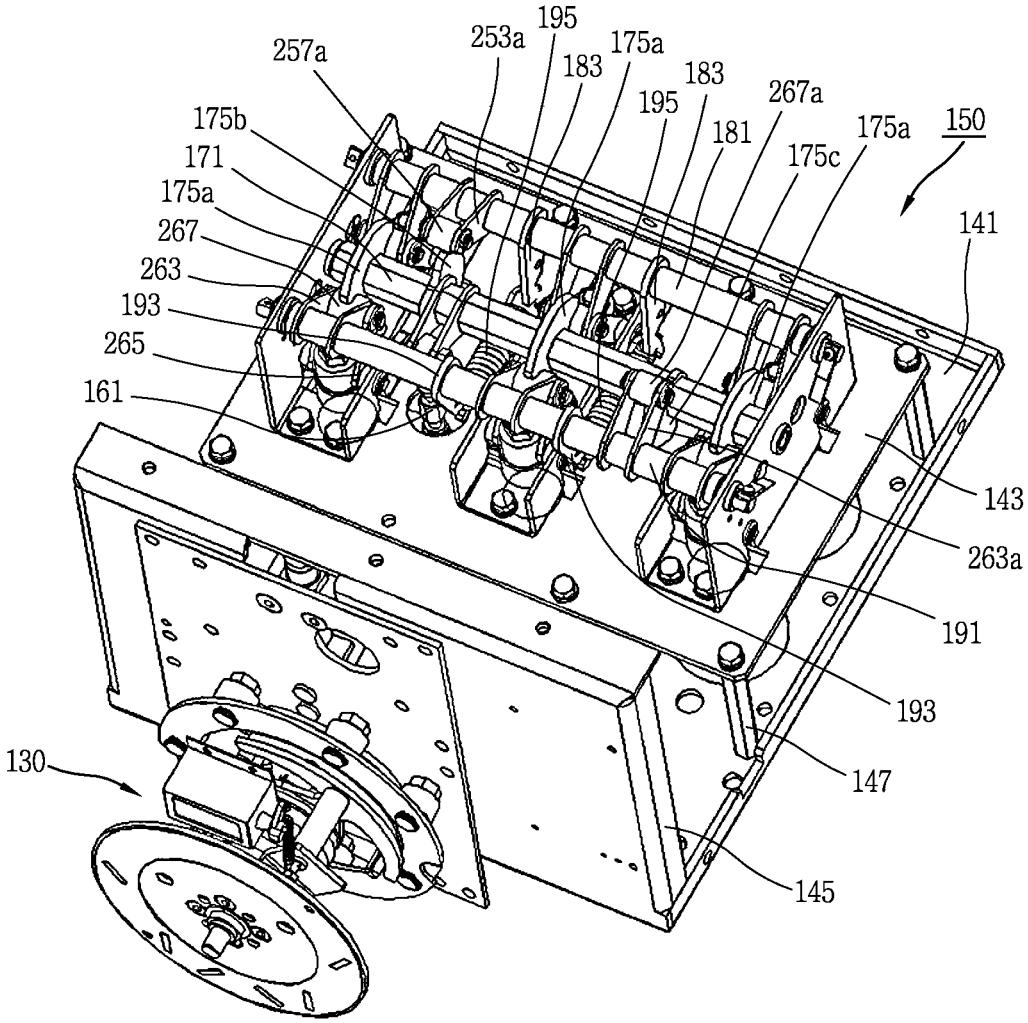
FIG. 1 is a perspective view of a power transmission apparatus of a high voltage load breaker switch (LBS) according to a preferred embodiment of the present invention.
Figure 2:
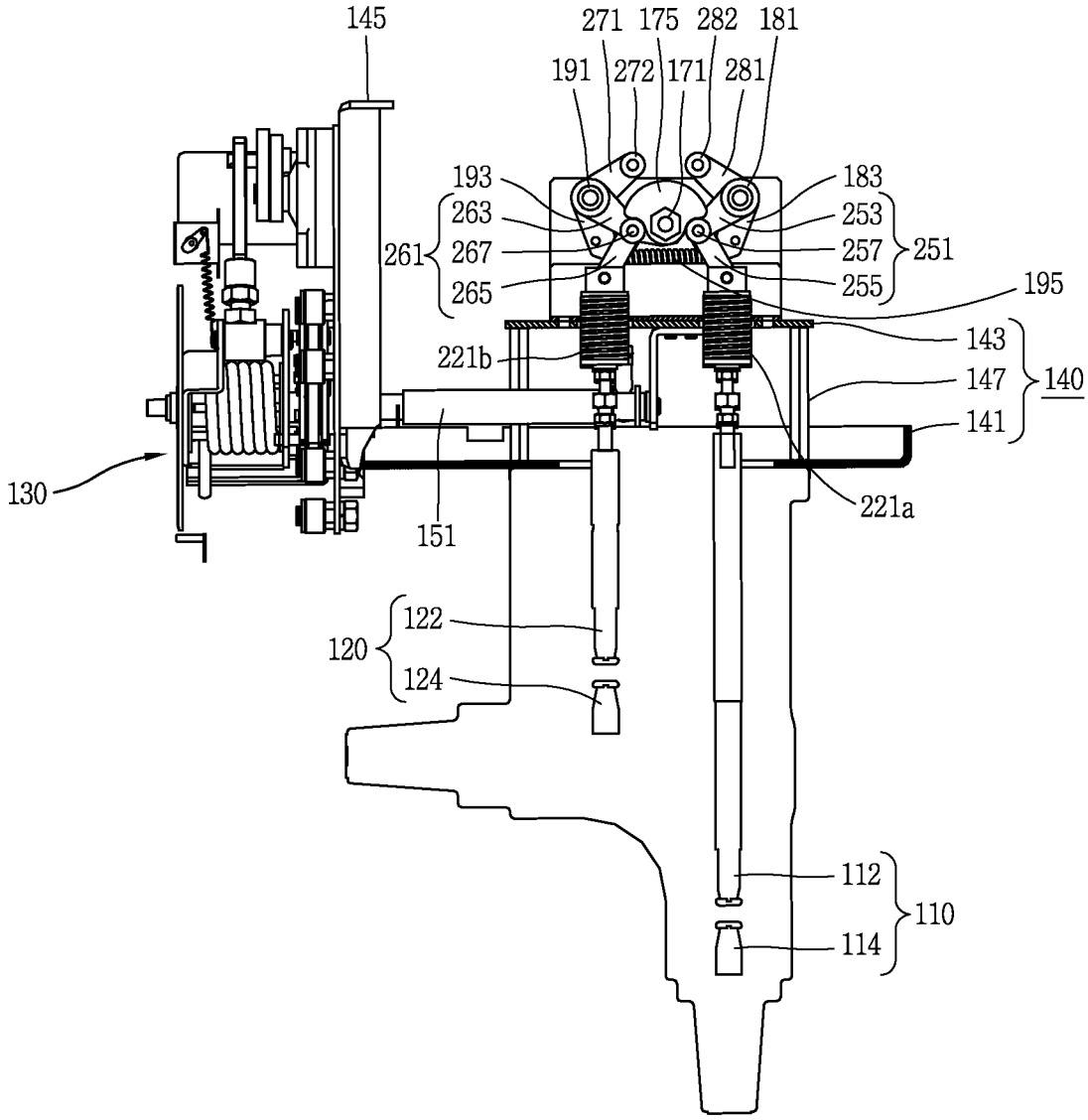
FIG. 2 is a vertical sectional view of the power transmission apparatus of FIG. 1.

With reference to FIGS. 1 and 2, the high voltage LBS having the power transmission apparatus according to an preferred embodiment of the present invention may comprise a main circuit switch 110, a ground circuit switch (in other words an earthing switch) 120 for switching a ground circuit connected to the earth, an actuator mechanism 130 for driving the main circuit switch 10 and the ground circuit switch 120 to a closing or opening position, respectively, and a power transmission apparatus 150 for transferring a driving force from the actuator mechanism 130 to the main circuit switch 110 and the ground circuit switch 120.

A lower plate designated by reference numeral 141, a side plate designated by reference numeral 145, and a supporting rod designated by reference numeral 147 in FIG. 1 are components comprised in a supporting frame 140 in FIG. 2.

In FIG. 1, the lower plate 141 is a support plate formed to be separated from the side plate 145 or formed by integrally bending the side plate 145, horizontally installed, and supporting the power transmission apparatus 150 of the high LBS according to a preferred embodiment of the present invention.

The side plate (or in other words front plate) 145 is a support plate for fixedly supporting the actuator mechanism 130 on a front surface of the high voltage LBS.

The supporting rod 147 is a rod supporting an upper plate 143 to maintain a predetermined space between the upper plate 143 and the lower plate 141. Four supporting rods may be provided to correspond to four corners of the upper plate 143. Bolts, each having a head portion formed at a lower end portion thereof and extending to penetrate the lower plate 141 and having an inner hole portion with threaded face formed at an upper end portion thereof, are installed to penetrate four corner portions of the upper plate 143, and then, the threaded face of the inner hole portion of the bolts and screws are fastened to thereby fix the positions of the supporting rod 147 such that it supports the four corners of the upper plate 143.

The upper plate 143 rotatably supports the plurality of driving shafts 171, 181, and 191 comprised in the power transmission apparatus 150 through the supporting bracket (reference numeral is not given) fixedly installed on the corresponding upper plate 143.

As shown in FIG. 2, the main circuit switch 110 comprises a movable contactor 112 and a stationary contactor 114, and at least three main circuit switches 110 may be provided to correspond to alternating three phases current. The movable contactor 112 and the stationary contactor 114 of any one of the three phases are surrounded by a solid insulating material such as epoxy and buried such that they are electrically insulated from the movable contactors and stationary contactors of the other phases and the ground circuit switch 120. The main circuit switch 110 has two operating positions: a closing position at which the movable contactor 112 contacts with the stationary contactor 114 to allow current to flow through the main circuit (namely, an electric power circuit from an electric power source to an electric load) and an opening position at which the movable contactor 112 is separated from the stationary contactor 114 to break the current flow through the main circuit.

As shown in FIG. 2, the ground circuit switch 120 may comprise a movable contactor 122 and a stationary contactor 124, and at least three ground circuit switches 120 may be provided to correspond to alternating three phases current. In any one of the three ground circuit switches 120 (any one ground circuit switch), the movable contactor 122 and the stationary contactor 124 are surrounded by a solid insulating material such as epoxy and buried such that they are electrically insulated from the movable contactors and stationary contactors of the other phases and the main circuit switch 110, like the main circuit switch 110. The ground circuit switch 120 has two operating positions: an earthing(ground) position at which the movable contactor 122 contacts with the stationary contactor 124 to bring the circuit about being earthed and an opening position at which the movable contactor 122 is separated from the stationary contactor 124 to interrupting the earthing of the circuit.

The actuator mechanism 120 may be configured as an actuator for charging a spring according to electrical operation by the motor or manually by a connection of the manipulation handle and discharging elastic energy charged in the spring to output the corresponding elastic energy as rotating driving force to rotatably drive a power transmission shaft 151 (to be described). A detailed configuration and operation of the actuator mechanism 130 are disclosed in Korean Patent Registration No. 0186357 (Entitled: Automatic contact actuating mechanism for 3-position multi-circuit switch) or Korean Patent Registration No. 0564435 (Entitled: 3-position load breaker switch having an instantaneous trip mechanism) filed by the applicant of the present invention.

The power transmission apparatus 150 for the high voltage LBS according to an preferred embodiment of the present invention is disposed between the main circuit switch 110 and the ground circuit switch 120 and the actuator mechanism 130 to transfer driving force from the actuator mechanism 130 to the main circuit switch 110 and the ground circuit switch 120. The power transmission apparatus 150 comprises a power transmission shaft 151, a cam shaft 171, a first operating shaft 181, a second operating shaft 191, a main circuit contact spring unit 221*a*, a ground circuit contact spring unit 221*b*, a main circuit link unit 251, a ground circuit link unit 261, and an opening spring 195. As understood with reference to FIG. 1 or 2, the power transmission apparatus 150 may further comprise main circuit power transmission mechanisms 175*b* and 253*a* according to the present invention.

With reference to FIG. 2, as one end (a left end in FIG. 2) of the power transmission shaft 151 is connected to the actuator mechanism 130, the power transmission shaft 151 is rotatable upon receiving the rotating driving force from the actuator mechanism 130. A connecting lever (not shown) is installed at the other end (a right end in FIG. 2) of the power transmission shaft 151. The corresponding connecting lever connected to a lower end portion of the connecting rod 161 of FIG. 1 through a connection means such as a connection pin, or the like. The connecting rod 161 is a rod-like member which can be movable up and down according to the power transmission from the connecting lever according to the rotation of the power transmission shaft 151. An upper end portion of the connecting rod 161 is connected to the cam shaft 171 through a rod connecting lever (173 in FIG. 3). A figure and a description of a detailed configuration of the connecting rod 161 and its connection configuration may refer to FIG. 7 and a description of the configuration thereof in Korean Patent Registration No. 0832331.

Figure 3:
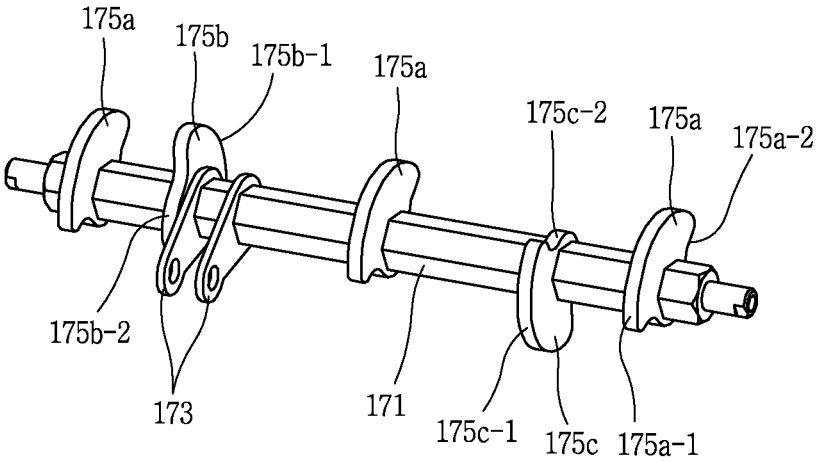
FIG. 3 is a perspective view of a cam shaft of the power transmission apparatus of the high voltage LBS according to a preferred embodiment of the present invention.

As shown in FIG. 2, the cam shaft 171 is disposed at an upper position of the main circuit switch 110 and the ground circuit switch 120, and as described above, the cam shaft 171 is connected to the power transmission shaft 151 by way of the connecting rod 161 so as to be rotatable by interlocking with the power transmission shaft 151. With reference to FIGS. 2 and 3, the cam shaft 171 may be configured as a metal rod having a hexagonal sectional shape obtained by cutting in a traverse manner in a lengthwise direction. As shown in FIG. 3, three main cams 175*a* corresponding to the three phases of Alternating Current and a pair of connecting levers 173 for connecting the connecting rod (161 in FIG. 1) by a connection pin (not shown) are supported by the cam shaft 171. As shown in FIG. 3, each of the main cams 175*a* comprise a first curvature radius portion 175*a*-1 having a larger curvature radius and a second curvature radius portion 175*a*-2 having a curvature radius smaller than that of the first curvature radius portion 175*a*-1.

The first operating shaft 181 switches and drives the main circuit switch 110 provided for each phase of the three AC phases. In order to switch and drive the main circuit switch 110, as shown in FIG. 2, the first operating shaft 181 is connected to the movable contactor 112 of the main circuit switch 110 through the main circuit link unit 251 and the main circuit contact spring unit 221*a*.

The second operating shaft 191 switches and drives the ground circuit switch 120 provided for each phase of the three AC phases. In order to switch and drive the ground circuit switch 120, as shown in FIG. 2, the second operating shaft 191 is connected to the movable contactor 122 of the ground circuit switch 120 through the ground circuit link unit 261 and the ground circuit contact spring unit 221*b*.

As shown in FIG. 1, the cam shaft 171, the first operating shaft 181, and the second operating shaft 191 are rotatably supported by a plurality of supporting brackets (no reference numeral given) fixed on the upper plate 43.

As shown in FIG. 2, an upper portion of the main circuit contact spring unit 221*a* is connected to the first operating shaft 181 through the main circuit link unit 251, and a lower portion thereof is connected to the movable contactor 112 of the main circuit switch 110, to transfer switching driving force from the first operating shaft 181 delivered through the main circuit link unit 251 to the movable contactor 112 of the main circuit switch 110. The main circuit contact spring unit 221*a* may be configured to comprise a rod (no reference numeral given) connected to the movable contactor 112 of the main circuit switch 110 and a contact spring (no reference numeral given) installed at an outer side of the rod. The rod may be configured to comprise an upper rod portion (no reference numeral given) supporting the contact spring and a lower rod portion (no reference numeral given) having one end connected to a lower portion of the upper rod portion and the other end connected to the movable contactor 112 of the main circuit switch 110. A detailed configuration of the main circuit contact spring unit 221*a* may refer to FIGS. 10 and 11 and a description of the configuration disclosed in Korean Patent Registration No. 0832331.

As shown in FIG. 2, an upper portion of the ground circuit contact spring unit 221*b* is connected to the second operating shaft 191 through the ground circuit link unit 261 and a lower portion thereof is connected to the movable contactor 122 of the ground circuit switch 120 to thus deliver switching driving force from the second operating shaft 191 delivered through the ground circuit link unit 261 to the movable contactor 122 of the ground circuit switch 120. The ground circuit contact spring unit 221*b* may be configured to comprise a rod (no reference numeral given) connected to the movable contactor 122 of the ground circuit switch 120 and a contact spring (no reference numeral given) installed at an outer side of the rod. The rod may be configured to comprise an upper rod portion (no reference numeral given) supporting the contact spring and a lower rod portion (no reference numeral given) having one end connected to a lower portion of the upper rod portion and the other end connected to the movable contactor 122 of the ground circuit switch 120. A detailed configuration of the ground circuit contact spring unit 221*b* may also refer to FIGS. 10 and 11 and a description of the configuration disclosed in Korean Patent Registration No. 0832331.

Figure 4:
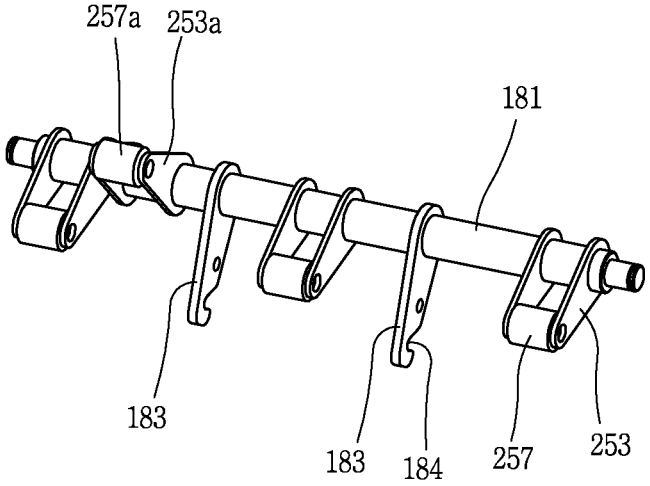
FIG. 4 is a perspective view of a first operating shaft of the power transmission apparatus of the high voltage LBS according to a preferred embodiment of the present invention.
Figure 5:
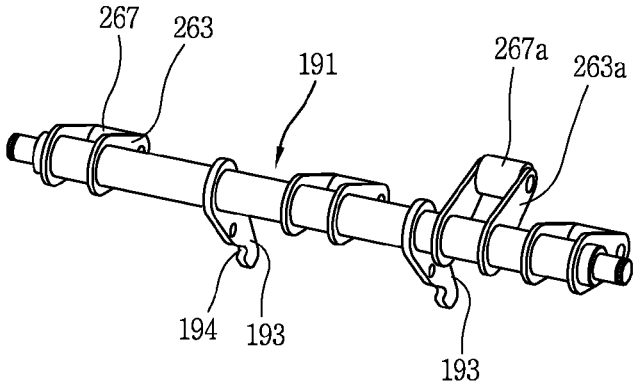
FIG. 5 is a perspective view of a second operating shaft of the power transmission apparatus of the high voltage LBS according to a preferred embodiment of the present invention.

The main circuit link unit 251 comprises a pair of links connected to the first operating shaft 181 and the main circuit contact spring unit 221*a*, and a connection portion of the pair of links is in contact with one side of the main cam 175*a*. In detail, as shown in FIG. 2 or FIG. 4, the main circuit link unit 251 comprises a first link 253, a second link 255, and a roller 257. Here, three pairs of first links 253 may be provided to correspond to the main circuit switches 110 corresponding to the three phases, and the first link 253 of each pair is connected to the first operating shaft 181. Although not shown in FIG. 4, three pairs of second links 255 may be provided to correspond to the three pairs of the first links 253. An upper end portion of the respective pairs of the second links 255 may be connected to the first link 253 by a connection pin and a lower end portion thereof may be connected to the main circuit contact spring unit 221*a*. The roller 257 is rotatably installed on the connection pin corresponding to the connection portion between the first link 253 and the second link 255 such that it can be rollingly in contact with the main cam 175*a*.

The ground circuit link unit 261 comprises a pair of links connected to the second operating shaft and the ground circuit contact spring unit and a connection portion thereof is in contact with the other side of the cam. In detail, as shown in FIGS. 1 and 2, the ground circuit link unit 261 comprises a third link 263, a fourth link 265, and a roller 267. Here, three pairs of third links 263 may be provided to correspond to the ground circuit switches 120 corresponding to the three phases, and the third link 263 of each pair is connected to the second operating shaft 191. Three pairs of fourth links 265 may be provided to correspond to the three pairs of the third links 263. An upper end portion of the respective pairs of the fourth links 265 may be connected to the third link 263 by a connection pin and a lower end portion thereof may be connected to the ground circuit contact spring unit 221*b*. The roller 267 is rotatably installed on the connection pin corresponding to the connection portion between the third link 263 and the fourth link 265 such that it can be rollingly in contact with the main cam 175*a*.

As shown in FIG. 1, the opening spring 195 is connected between the first operating shaft 181 and the second operating shaft 191 to provide elastic force to the first operating shaft 181 to rotate it when in the opening operation of the main circuit switch 110. In detail, as shown in FIG. 1, a pair of opening springs 195 may be configured, and both end portions of the opening spring 195 are supportedly installed at a pair of first spring supporting lever 183 receiving the first operating shaft 181 and a pair of second spring supporting levers 193 receiving the second operating shaft 191. In order to support both end portions of the pair of opening springs 195, the first spring supporting lever 183 and the second spring supporting lever 193 have a spring supporting recess as designated by reference numeral 184 in FIG. 4.

Thus, in FIG. 2, when the first operating shaft 181 rotates in the counterclockwise direction or when the second operating shaft 191 rotates in the clockwise direction, the opening spring 195 tensed to charge elastic energy. And if the opening spring 195 discharges the charged elastic energy, the discharging elastic energy may drive the first operating shaft 181 or the second operating shaft 191 to rotate. The rotational driving force of the first operating shaft 181 or the second operating shaft 191 operates the movable contactor of the main circuit switch 110 or the ground circuit switch 120 to be separated from the stationary contactor.

As shown in FIGS. 1 to 4, in moving the main circuit switch 110 to the opening position, the main circuit power transmission mechanisms 175*b* and 253*a* transmits opening position rotating power of the power transmission shaft 151 to the main circuit switch 110 to operate to the opening position. To this end, as shown in FIG. 1, the main circuit power transmission mechanisms 175*b* and 253*a* comprises the opening cam 175*b* and the opening link unit 253*a*.

As shown in FIG. 3, the opening cam 175*b* is coaxially installed with the main cam 175*a* on the cam shaft 171 but installed at a different installation angle from installation angle of the main cam 175*a*, so that it can be rotatable according to the rotation of the cam shaft 171. In other words, according to an embodiment, as shown in FIG. 3, the opening cam 175*b* is installed at a position it has been rotated by 90 degrees in the clockwise direction with respect to the main cam 175*a* on the cam shaft 171. Meanwhile, according to an embodiment, a ground circuit auxiliary driving cam 175*c* (to be described) is installed at a particular position upon being rotated 90 degrees in the counterclockwise direction with respect to the main cam 175*a* on the cam shaft 171. Also, with reference to FIG. 3, the opening cam 175*b* has a first curvature radius portion 175*b*-1 having a larger curvature radius and a second curvature radius portion 175*b*-2 having a curvature radius smaller than that of the first curvature radius portion 175*b*-1.

As shown in FIG. 4, the opening link unit 253*a* is coaxially installed with the main circuit link unit 251 on the first operating shaft 181 but installed at a different installation angle from installation angle of the first link 253 of the main circuit link unit and is brought into contact with the rotating opening cam 175*b* to transmit driving force to the first operating shaft 181. In other words, as shown in FIG. 4, according to an embodiment, the opening link unit 253*a* may be installed at a predetermined position that rotated 45 degrees in the clockwise direction compared with the first link 253 of the main circuit link unit. The roller 275*a* is installed at an upper end portion of the opening link unit 253*a* such that it is rotatable supported by the rotational shaft such as a pin (not shown) such that it can be brought into contact rotatably with the opening cam 175*b*.

The power transmission apparatus of the high voltage LBS according to an preferred embodiment of the present invention may further comprise ground circuit power transmission mechanisms 175*c*, 263*a*, and 267*a* for transmitting ground position rotary power of the power transmission shaft 151 to a ground position of the ground circuit switch 120 so that the ground circuit switch 120 can move to the ground position.

Figure 6:
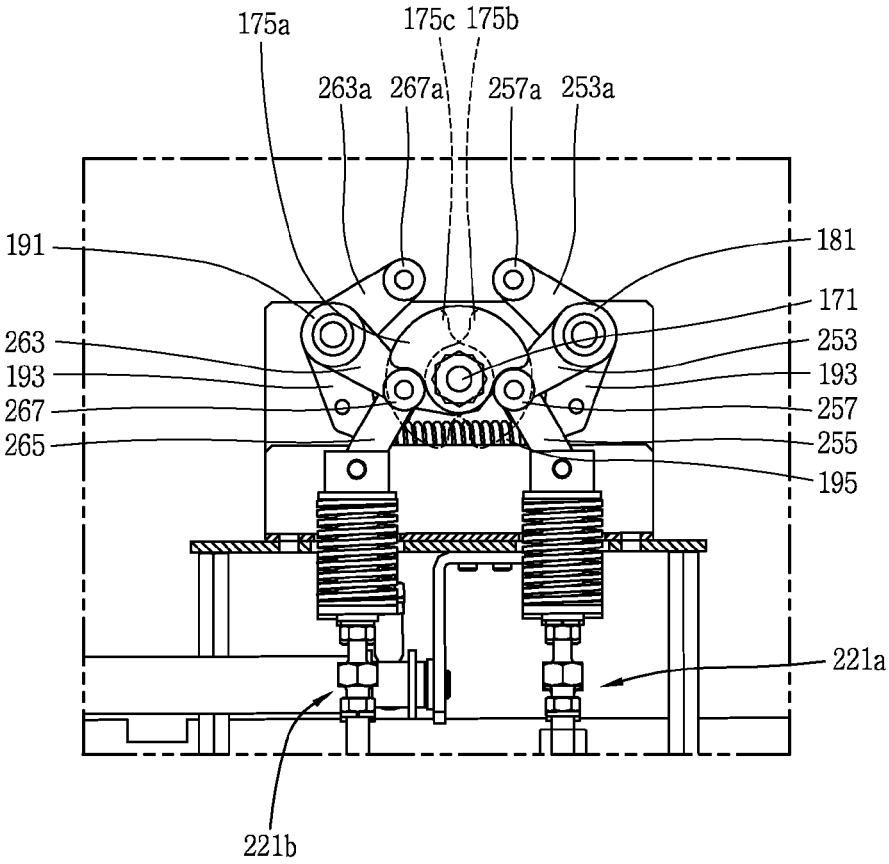
FIG. 6 is a partial side view showing the state of a major part of the power transmission apparatus of the high voltage LBS according to a preferred embodiment of the present invention in an opening completed state.

As shown in FIG. 6, the ground circuit power transmission mechanisms 175*c*, 263*a*, and 267*a* comprise the ground circuit auxiliary driving cam 175*c* and the auxiliary ground circuit link unit 263*a*.

As shown in FIG. 6, the ground circuit power transmission mechanisms 175*c*, 263*a*, and 267*a* may further comprise the roller 267*a*. The roller 267*a*, which can be brought into contact rotatably with the ground circuit auxiliary driving cam 175*c*, is rotatably installed supported by the rotational shaft such as a pin (not shown) at an upper end portion of the auxiliary ground circuit link unit 263*a*.

The ground circuit auxiliary driving cam 175*c* is coaxially installed with the main cam 175*a* on the cam shaft 171 but installed at a different installation angle from installation angle of the main cam 175*a* and is rotatable according to the rotation of the cam shaft 171. In other words, as shown in FIG. 3, according to an embodiment, the ground circuit auxiliary driving cam 175*c* is installed on a predetermined position upon being rotated 90 degrees in the counterclockwise direction with respect to the main cam 175*a* on the cam shaft 171. Also, with reference to FIG. 3, the ground circuit auxiliary driving cam 175*c* has a first curvature radius portion 175*c*-1 having a larger curvature radius and a second curvature radius portion 175*c*-2 having a curvature radius smaller than that of the first curvature radius portion 175*b*-1.

As shown in FIGS. 1 to 5, the auxiliary ground circuit link unit 263*a* is coaxially installed with the ground circuit link unit 261 on the second operating shaft 191 but installed at a different installation angle from installation angle of the ground circuit link unit 261, and is brought into contact with the rotating ground circuit auxiliary driving cam 175*c* to transmit driving force to the second operating shaft 191.

Meanwhile, the operation of the power transmission apparatus of the high voltage LBS configured as described above according to an preferred embodiment of the present invention will now be described with reference to FIGS. 1 to 6.

First, the opening operation of the main circuit of the power transmission apparatus of the high voltage LBS according to a preferred embodiment of the present invention will be described as follows.

When the actuator mechanism 130 transmits rotation driving force to the main circuit opening position in a motor-driven manner or manually, the power transmission shaft 151 rotates in the counterclockwise direction by the actuator mechanism 130, the connecting rod 161 connected to the power transmission shaft 151 by the connecting lever (173 in FIG. 3) moves downward, and the cam shaft 171 connected to the connecting rod 161 rotates in the counterclockwise direction to reach the position shown in FIG. 2. Immediately when the roller 257 is brought into contact with the second curvature radius portion 175*a*-2 having a smaller curvature radius from the first curvature radius portion 175*a*-1 having a larger curvature radius, the opening spring 195 discharges charged elastic energy, so the main circuit link unit 251 and the first operating shaft 181 quickly rotate in the clockwise direction to the initial (neutral) position illustrated in FIG. 2, and accordingly, the roller 257 simultaneously moves to the left and upper sides as shown in FIG. 2. Accordingly, the first operating shaft 181 preferentially rotates in the clockwise direction by the discharged elastic energy of the opening spring 195 and the lower end portion of the second link 255 rotates in the clockwise direction and moves upward to pull upward the main circuit contact spring unit 221*a*. The rod (no reference numeral given) of the main circuit contact spring unit 221*a*, which has been pulled upward, is lifted and the movable contactor 112 of the main circuit switch 110 moves upward so as to be quickly separated from the stationary contactor 114. At this time, the cam shaft 171 rotating and driven in the counterclockwise direction in FIG. 1 rotates by the opening driving force transmitted to the cam shaft 171 through the connecting rod 161 from the power transmission shaft 151, namely, through the downwardly moving connecting rod 161 and connecting lever 173. Accordingly, in FIG. 1, as the opening cam 175*b* rotates in the counterclockwise direction, the first curvature radius portion 175*b*-1 having a larger curvature radius of the opening cam 175*b* presses the roller 257*a* to make the first operation shaft 181 rotate and drive in the clockwise direction (i.e., the opening direction of the main circuit). In this manner, unlike the related art, in the power transmission apparatus of the high voltage LBS according to an preferred embodiment of the present invention, rather than opening and driving the main circuit by using the elastic energy charged in the trip spring 195, the opening driving force successively transmitted to the cam shaft 171 from the power transmission shaft 151 is transmitted to the first operating shaft 181 through the opening link unit 253*a* receiving the first operating shaft 181, the switching operating shaft of the main circuit opening cam 175*b* and the roller 257*a*, so as to be utilized for the opening operation of the main circuit. Thus, compared with the related art, the reliable opening operation of the high voltage LBS can be guaranteed.

Thus, the opening (or TRIP or OFF position) operation of the main circuit can be achieved, and the main circuits of the power source and the load is electrically interrupted.

A closing operation of the main circuit will now be described.

When the actuator mechanism 130 transmits rotation driving force to the main circuit closing position in a motor-driven manner or manually, the power transmission shaft 151 rotates in the same direction as that of the central shaft, an output shaft, of the actuator mechanism 130, namely, in the clockwise direction in FIG. 1 or 2. Accordingly, the connecting rod 161 connected to the power transmission shaft 151 by the connecting lever moves upward, and the cam shaft 171 connected to the connecting rod 161 by the connecting lever (173 in FIG. 3) rotates in the clockwise direction from the state illustrated in FIG. 2. Then, the roller 257 of the main circuit link unit 251 in contact with the second curvature radius portion 175*a*-2 having a smaller curvature radius of the main cam 175*a* is brought into contact with the first curvature radius portion 175*a*-1 having a curvature radius greater than that of the second curvature radius portion 175*a*-2 and pressed, and accordingly, the roller 257 moves rightward and downward simultaneously in FIG. 2. In this case, as shown in FIG. 1, when the cam shaft 171 rotates in the clockwise direction, the opening cam 175*b* according to a preferred embodiment of the present invention is not in contact with the roller 257*a* shaft-receiving the first operating shaft 181, so interference by the opening cam 175*b* is not generated. Meanwhile, accordingly, the first operating shaft 181 rotates in the counterclockwise direction, and the lower end portion of the second link 255 rotates in the clockwise direction and moves downward to downwardly press the main circuit contact spring unit 221*a*. The rod (no reference numeral given) of the downwardly pressed main circuit contact spring unit 221*a* moves downward, and the movable contactor 112 of the main circuit switch 110 moves downward so as to be brought into contact with the stationary contactor 114. Accordingly, the closing operation (i.e., an ON position) of the main circuit is achieved and the power source side and the load side of the main circuit are electrically connected. In this process, as the first operating shaft 181 rotates in the counterclockwise direction, the first spring supporting lever 183 also rotates in the counterclockwise direction. Accordingly, the opening spring 195 is tensed to charge elastic energy.

The grounding and grounding interruption operation of the power transmission apparatus of the high voltage LBS according to a preferred embodiment of the present invention will now be described.

When a central shaft of the actuator mechanism 130 rotates in the counterclockwise direction from a neutral position of the main cam 175 as shown in FIG. 2 in a motor-driven manner such as a ground closing signal, or the like, or manually through a user's manipulation of a handle, the power transmission shaft 151 rotates in the counterclockwise direction. Accordingly, the connecting rod 161 connected to the power transmission shaft 151 by the connecting lever downwardly moves, and the camp shaft 171 connected to the connecting rod 161 by the connecting lever (173 in FIG. 3) rotates in the counterclockwise direction from the state illustrated in FIG. 2. Accordingly, the roller 267 of the ground circuit link unit 261 brought into contact with the first curvature radius portion 175*a*1 from the position in contact with the second curvature radius portion 175*a*-2 of the main cam 175 is pressed by the main cam 175 and simultaneously moves outward and downward and the second operating shaft 191 rotates in the clockwise direction. Accordingly, the rod of the ground circuit contact spring unit 221*b* moves downward, and the movable contactor 122 of the ground circuit switch 120 is brought into contact with the stationary contactor 124. Accordingly, the ground circuit is grounded in the state in which it is cut off by circuitry as illustrated in FIG. 2, allowing the remaining charged current to be all discharged to the earth, and accordingly, the operator working on the branching of distribution line by using the high voltage LBS, maintenance, or the like, can be safely protected from an electric shock accident. At this time, the opening spring 195 is tensed according to the rotation of the second operating shaft 191 to accumulate elastic force.

Meanwhile, in this state, as the power transmission shaft 151 rotates in the clockwise direction by the actuator mechanism 130, the cam shaft 171 rotates in the clockwise direction. Accordingly, the main cam 175 rotates in the clockwise direction, the roller 267 is brought into contact with the second curvature radius portion 175*a*-2 having a small radius from the first curvature radius portion 175*a*-1 having a great radius of the main cam 175, the second operating shaft 191 is quickly rotates in the counterclockwise direction by the elastic force of the opening spring 195, and the rod 230 moves quickly upward. At this time, the cam shaft 171 which rotates and is driven in the clockwise direction rotates by the driving force for interrupting grounding (i.e., a state in which the ground circuit switch is at the opening position) transferred to the cam shaft 171 through the connecting rod 161 from the power transmission shaft 151, namely, through the connecting rod 161 and the connecting lever 175. Accordingly, as the ground circuit auxiliary driving cam 175*c* in FIG. 1 rotates in the clockwise direction, the first curvature radius portion 175*c*-1 having a great curvature radius of the ground circuit auxiliary driving cam 175*c* presses the roller 267*a* to rotatably drive the second operating shaft 191 in the counterclockwise direction (i.e., the opening direction of the ground circuit, so-called a ground interrupting direction). In this manner, unlike the related art, the power transmission apparatus of the high voltage LBS according to an preferred embodiment of the present invention, rather than opening and driving (i.e., grounding interrupting driving) the ground circuit by using the elastic energy charged in the opening spring 195, the opening driving force successively transmitted to the cam shaft 171 from the power transmission shaft 151 is transmitted to the second operating shaft 191 through the auxiliary ground circuit link unit 263*a* and the roller 267*a* shaft-receiving the second operating shaft 191, the switching operating shaft of the ground circuit and the auxiliary driving cam 175*c*, so as to be utilized for the opening operation (the grounding interrupting operation) of the ground circuit. Thus, compared with the related art, the reliable grounding interrupting operation of the high voltage LBS can be guaranteed.

Accordingly, the movable contactor 122 of the ground circuit switch 120 can be quickly separated from the stationary contactor 124 and the grounding of the ground circuit is interrupted.

Since the power transmission apparatus of the high voltage LBS according to an preferred embodiment of the present invention comprises the main circuit power transmission mechanism for transferring the opening position rotation power of the power transmission shaft to the main circuit switch to operate the main circuit switch to the opening position, the driving source of the opening driving power is dualized, thus obtaining the effect of improving the reliability of opening operation.

The main circuit opening power transmission mechanism in the power transmission apparatus of the high voltage LBS according to an preferred embodiment of the present invention comprises an opening cam coaxially installed with the main cam at the cam shaft but installed at a different installation angle from installation angle of the main cam, and being rotatable according to a rotation of the cam shaft; and an opening link unit coaxially installed with the main circuit link unit at the first operating shaft but installed at a different installation angle from installation angle of the main circuit link unit, and brought into contact with the rotating opening cam to transfer a driving force to the first operating shaft. Thus, since the rotation power of the cam shaft rotated upon receiving it through the power transmission shaft from the actuator mechanism is transferred to the first operating shaft through the opening cam, the driving source of the opening driving power is dualized besides the elastic driving force of the opening spring, thus obtaining the effect of improving the reliability of opening operation.

Since the power transmission apparatus of the high voltage LBS according to an preferred embodiment of the present invention further comprises ground circuit power transmission mechanisms transmitting ground interruption position rotation power of the power transmission shaft to the ground circuit switch to make the ground circuit switch to move to a ground interruption position, the reliability of the ground interruption operation of the ground circuit switch can be further improved.

The ground circuit power transmission mechanism in the power transmission apparatus of the high voltage LBS according to an preferred embodiment of the present invention further comprises a ground circuit auxiliary driving cam coaxially installed with the main cam at the cam shaft but installed at a different installation angle from installation angle of the main cam, and being rotatably according to a rotation of the cam shaft, and an auxiliary ground circuit link unit coaxially installed with the ground circuit link unit at the second operating shaft but installed at a different installation angle from installation angle of the ground circuit link unit, and brought into contact with the rotating ground circuit auxiliary driving cam to transfer a driving force to the second operating shaft.

Thus, the charged elastic energy of the opening spring is preferentially used, and the rotary power of the cam shaft rotated upon receiving it through the power transmission shaft from the actuator mechanism is transferred to the second operating shaft through the auxiliary driving cam and the main cam to transfer the grounding interruption position driving of the second operating shaft so as to be used, thus further improving the reliability of the grounding stop operation.

As the present invention may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A high voltage load breaker switch comprising:

a main circuit switch for switching a main circuit between an electric power source and an electric load;

a ground circuit switch for switching a ground circuit;

an actuator mechanism for actuating the main circuit switch and the ground circuit switch to a closing position or an opening position; and a power transmission apparatus for the high voltage load breaker switch disposed between the main circuit switch and the actuating mechanism and between the ground circuit switch and the actuating mechanism to transfer a driving force from the actuating mechanism to the main circuit switch and the ground circuit switch, the power transmission apparatus comprising:

a power transmission shaft having one end connected to the actuating mechanism;

a cam shaft connected to interlock with the power transmission shaft and having a main cam;

a first operating shaft for driving the main circuit switch to switch a closing position or an opening position;

a second operating shaft for driving the ground circuit switch to switch a closing position or an opening position;

a main circuit link unit having a pair of links connected to the first operating shaft and the main circuit switch respectively and being contactable with one side of the main cam;

a ground circuit link unit having a pair of links connected to the second operating shaft and the ground circuit switch respectively and being contactable with the other side of the main cam;

an opening spring connected between the first operating shaft and the second operating shaft and providing the first operating shaft with an elastic force to rotate when the main circuit switch performs an opening operation; and a main circuit opening power transmission mechanisms for transferring opening position rotating power of the power transmission shaft to the main circuit switch to enable the main circuit switch to move to an opening position.

2. The high voltage load breaker switch of claim 1, the main circuit opening power transmission mechanisms comprising:

an opening cam coaxially installed with the main cam on the cam shaft but installed at a different installation angle from installation angle of the main cam, and being rotatable according to a rotation of the cam shaft; and an opening link unit coaxially installed with the main circuit link unit on the first operating shaft but installed at a different installation angle from installation angle of the main circuit link unit, and being contactable with the rotating opening cam to transfer a driving force from the opening cam to the first operating shaft.

3. The high voltage load breaker switch of claim 2, the main circuit opening power transmission mechanisms further comprising:

a roller installed to be rotatable at an upper end portion of the opening link unit such that it can be brought into contact rotatably with the opening cam.

4. The high voltage load breaker switch of claim 1, further comprising:

a ground circuit power transmission mechanism that transmits ground interruption position rotating power of the power transmission shaft to the ground circuit switch to operate to a ground interruption position.

5. The high voltage load breaker switch of claim 4, the ground circuit power transmission mechanism comprising:

a ground circuit auxiliary driving cam coaxially installed with the main cam on the cam shaft but installed at a different installation angle from installation angle of the main cam, and being rotatable according to a rotation of the cam shaft; and an auxiliary ground circuit link unit coaxially installed with the ground circuit link unit on the second operating shaft but installed at a different installation angle from installation angle of the ground circuit link unit, and being contactable with the rotating ground circuit auxiliary driving cam to transfer a driving force from the ground circuit auxiliary driving cam to the second operating shaft.

6. The high voltage load breaker switch of claim 5, the ground circuit power transmission mechanism further comprising:

a roller rotatably installed at an upper end portion of the auxiliary ground circuit link unit such that it can be brought into contact rotatably with the ground circuit auxiliary driving cam.

* * * * *